US005422799A

United States Patent [19]

Morrison, Sr.

[11] Patent Number: 5,422,799

[45] Date of Patent: Jun. 6, 1995

[54] INDICATING FLASHLIGHT

[76] Inventor: Donald J. Morrison, Sr., 529 Smiley Rd., Hampton, Va. 23663

[21] Appl. No.: 306,591

[22] Filed: Sep. 15, 1994

[51] Int. Cl.[6] ..... F21L 15/00

[52] U.S. Cl. ..... 362/208; 362/184

[58] Field of Search ..... 362/184, 208, 458, 800, 362/157

[56] References Cited

U.S. PATENT DOCUMENTS

| | | | |
|---|---|---|---|
| 4,149,224 | 4/1979 | King et al. | 362/157 |
| 4,181,928 | 1/1980 | Zelina | 362/184 |
| 4,228,484 | 10/1980 | Johnstone | 362/184 |
| 4,325,107 | 4/1982 | MacLeod | 362/208 |
| 4,825,345 | 4/1989 | Stevens | 362/157 |
| 4,977,489 | 12/1990 | Fung | 362/184 |

*Primary Examiner*—Richard R. Cole

[57] ABSTRACT

A flashlight for providing illumination and indicating energization of the light bulb when the bulb is not visible. The inventive device includes a cylindrical main body having a lens and a light bulb coupled to a first end thereof. A plurality of batteries contained within the main body selectively energize the light bulb to provide illumination. A plurality of indicator lights are mounted about a circumference of the main body and are energized in unison with the light bulb. Thus, when the first end of the flash light is positioned upon a ground surface, the indicator lights serve to alert an individual to the light being left on.

6 Claims, 4 Drawing Sheets

INDICATING FLASHLIGHT

BACKGROUND OF THE INVENTION

1. Field of the Invention

The present invention relates to light structures and more particularly pertains to an indicating flashlight for providing illumination and indicating energization of the light bulb when the bulb is not visible.

2. Description of the Prior Art

The use of light structures is known in the prior art. More specifically, light structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art light structures include U.S. Pat. Nos. 4,905,130; 4,851,974; 4,722,036; 3,535,282 and D,333,358.

While these devices fulfill their respective, particular objectives and requirements, the aforementioned patents do not disclose an indicating flashlight for providing illumination and indicating energization of the light bulb when the bulb is not visible which includes a main body having a lens and a light bulb coupled to a first end thereof, with a plurality of indicator lights mounted about a circumference of the main body which are energized in unison with the light bulb such that when the first end of the flashlight is positioned upon a ground surface, the indicator lights serve to alert an individual to the light being left on.

In these respects, the indicating flashlight according to the present invention substantially departs from the conventional concepts and designs of the prior art, and in so doing provides an apparatus primarily developed for the purpose of providing illumination and indicating energization of the light bulb.

SUMMARY OF THE INVENTION

In view of the foregoing disadvantages inherent in the known types of light structures now present in the prior art, the present invention provides a new indicating flashlight construction wherein the same can be utilized for providing illumination and indicating energization of the light bulb when the bulb is not visible. As such, the general purpose of the present invention, which will be described subsequently in greater detail, is to provide a new indicating flashlight apparatus and method which has many of the advantages of the light structures mentioned heretofore and many novel features that result in a indicating flashlight which is not anticipated, rendered obvious, suggested, or even implied by any of the prior art light structures, either alone or in any combination thereof.

To attain this, the present invention generally comprises a flashlight for providing illumination and indicating energization of the light bulb when the bulb is not visible. The inventive device includes a cylindrical main body having a lens and a light bulb coupled to a first end thereof. A plurality of batteries contained within the main body selectively energize the light bulb to provide illumination. A plurality of indicator lights are mounted about a circumference of the main body and are energized in unison with the light bulb. Thus, when the first end of the flash light is positioned upon a ground surface, the indicator lights serve to alert an individual to the light being left on.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new indicating flashlight apparatus and method which has many of the advantages of the light structures mentioned heretofore and many novel features that result in a indicating flashlight which is not anticipated, rendered obvious, suggested, or even implied by any of the prior art light structures, either alone or in any combination thereof.

It is another object of the present invention to provide a new indicating flashlight which may be easily and efficiently manufactured and marketed.

It is a further object of the present invention to provide a new indicating flashlight which is of a durable and reliable construction.

An even further object of the present invention is to provide a new indicating flashlight which is susceptible of a low cost of manufacture with regard to both materials and labor, and which accordingly is then susceptible of low prices of sale to the consuming public, thereby making such indicating flashlights economically available to the buying public.

Still yet another object of the present invention is to provide a new indicating flashlight which provides in the apparatuses and methods of the prior art some of the advantages thereof, while simultaneously overcoming some of the disadvantages normally associated therewith.

Still another object of the present invention is to provide a new indicating flashlight for providing illumination and indicating energization of the light bulb when the bulb is not visible, such as when the lens end of the flashlight is positioned upon a ground surface.

Yet another object of the present invention is to provide a new indicating flashlight which includes a main body having a lens and a light bulb coupled to a first end thereof, with a plurality of indicator lights mounted about a circumference of the main body which are energized in unison with the light bulb such that when the first end of the flashlight is positioned upon a ground surface, the indicator lights serve to alert an individual to the light being left on.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
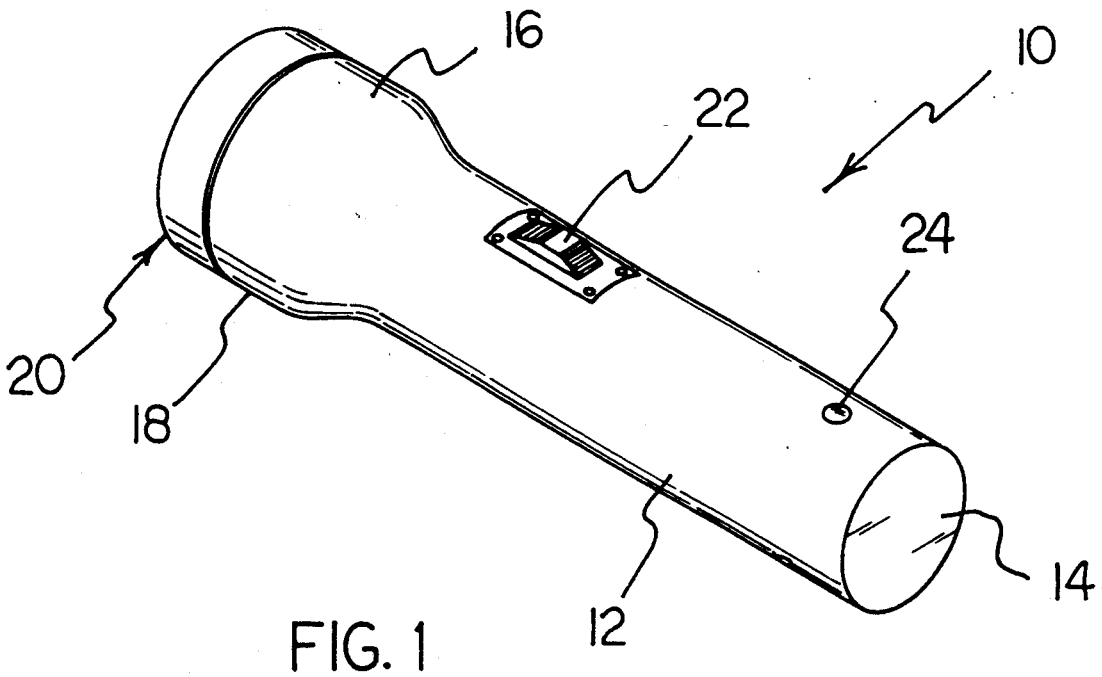
FIG. 1 is an isometric illustration of an indicating flashlight according to the present invention.

With reference now to the drawings, and in particular to FIGS. 1–8 thereof, a new indicating flashlight embodying the principles and concepts of the present invention and generally designated by the reference numeral 10 will be described.

More specifically, it will be noted that the indicating flashlight 10 comprises a substantially cylindrical main body 12 having a sealed first end 14 and an enlarged neck 16 formed at a second end 18 of the main body. A light means 20 is coupled to the second end 18 of the main body 12 and resides within the enlarged neck 16 thereof. The light means 20 is operated by a switch 22 mounted to an exterior surface of the main body 12, with the switch 22 being operable to selectively effect energization of the light means, whereby the flashlight 10 may be utilized to illuminate a surrounding area. A plurality of indicator lights 24 are mounted to an exterior surface of the main body 12 and electrically coupled to the switch 22 such that an energization of the light means 20 will simultaneously energize the indicator lights 24, thereby indicating such energization of the light means when the light means is not directly visible. Thus, when the flashlight 10 is positioned on a ground surface and the upstanding position illustrated in FIG. 2 wherein the light means 20 is not visible, the indicator lights 24 serve to alert an individual to the light 10 being left on.

Figure 3:
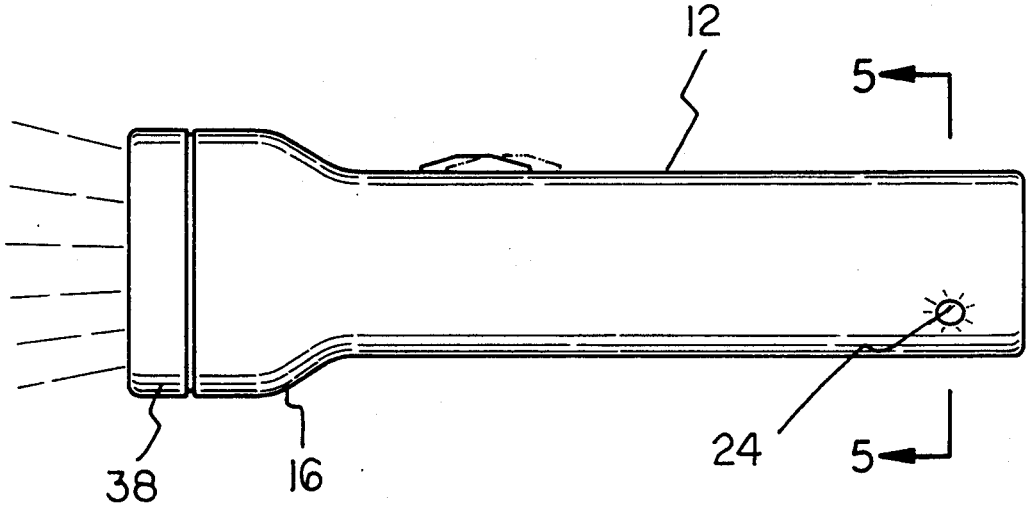
FIG. 3 is a side elevation view thereof.
Figure 4:
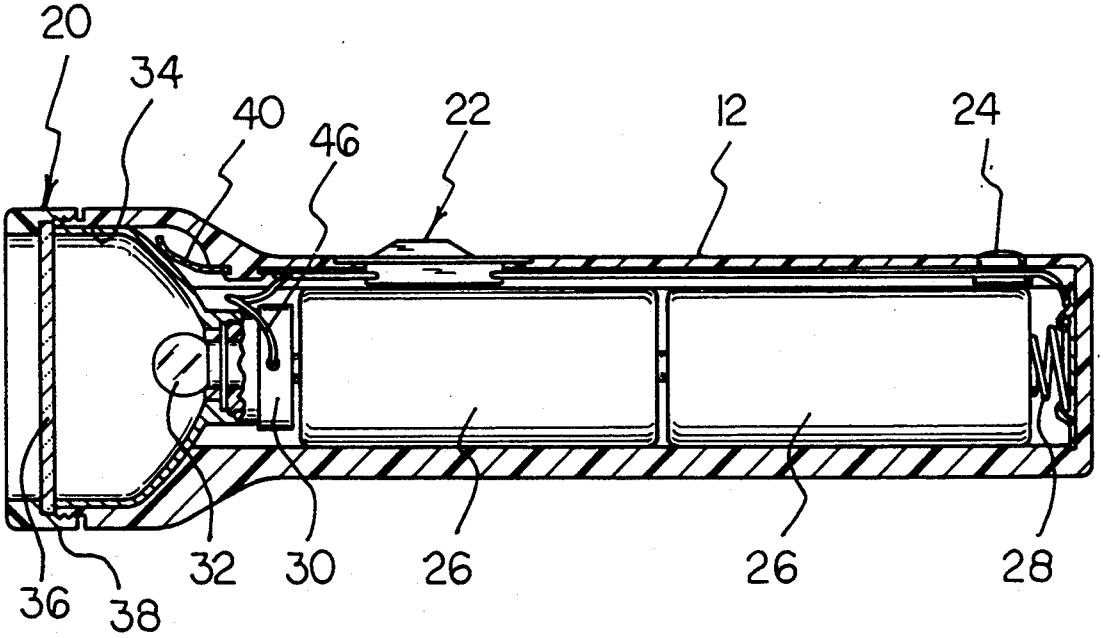
FIG. 4 is a cross section illustration of the flashlight detailing the interior components.

Turning now to FIGS. 3 and 4, wherein the present invention 10 is illustrated in detail, it can be shown that the main body 12 is substantially hollow and is operable to receive at least one battery 26 of cylindrical configuration therewithin. Preferably, the main body 12 will accommodate two batteries 26 in series, as illustrated. A spring contact 28 engages a first one of the batteries 26 and a bulb socket 30 engages a second one of the batteries. The bulb socket 30 is operable to support and electrically communicate with a light bulb 32 mounted therewithin. Thus, the light means 20 comprises the bulb socket 30 releasably coupled to a parabolic reflector 34 received within the enlarged neck 16 of the main body. Further, the light means 20 additionally includes a lens 36 extending across the parabolic reflector 34 and coupled thereto by a lens cap 38 threadably engaged to the enlarged neck 16 of the main body 12. The light bulb 32 receives positive electrical power from a second one of the batteries 26 through bulb socket 30, and receives negative electrical power through a leaf contact 40 engaged to the parabolic reflector 34 in electrical communication with the light bulb 32. Thus, by selectively coupling the leaf contact 40 into electrical communication with the spring contact 28, energization of the light bulb 32 will result.

Figure 7:
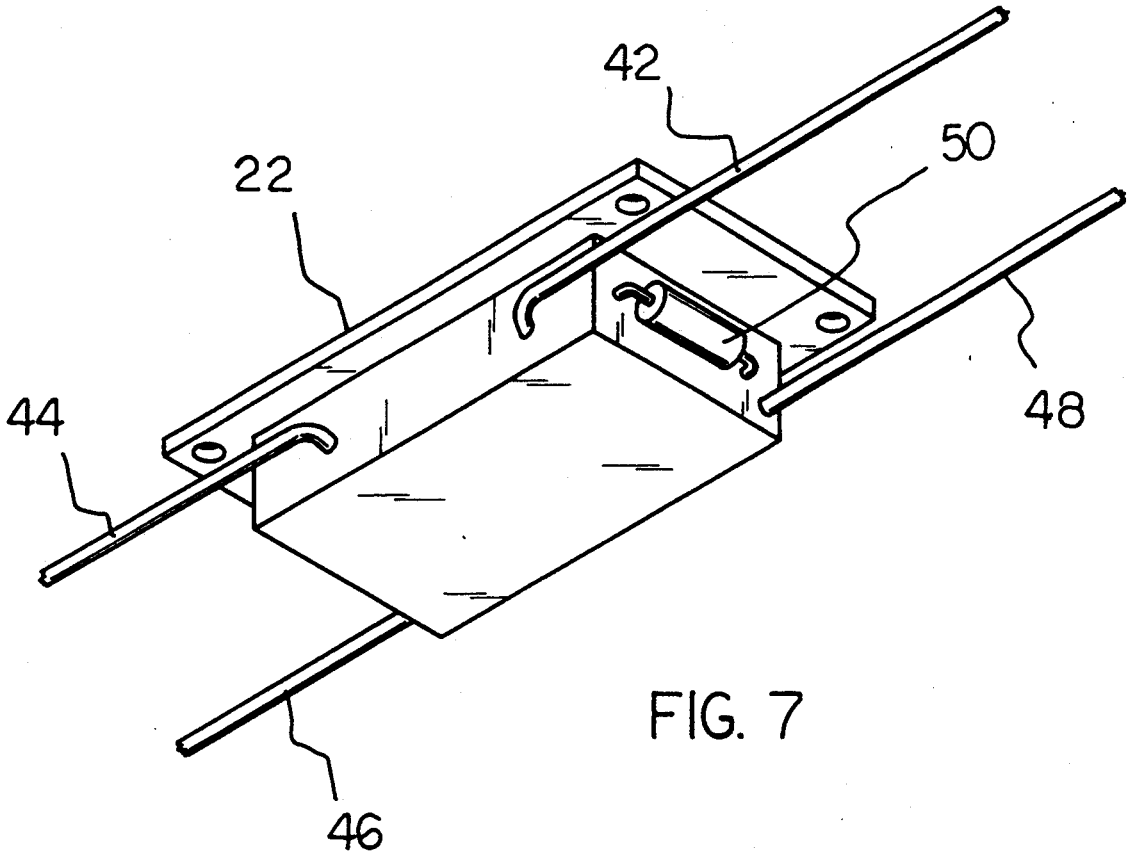
FIG. 7 is a further enlarged isometric illustration of a switch comprising a further portion of the present invention.
Figure 8:
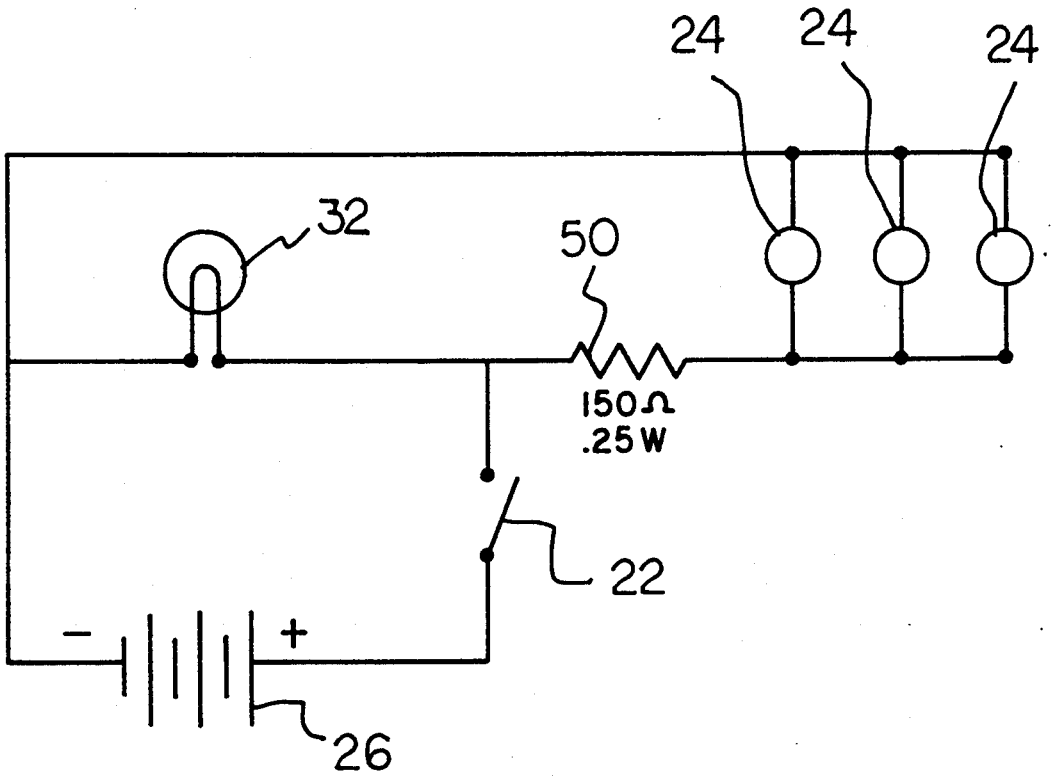
FIG. 8 is a diagrammatic illustration of the electrical circuitry of the present invention.

To effect selective energization of the light bulb 32 by electrically coupling the spring contact 28 to the leaf contact 40, a switch 22 is provided. The switch 22 is illustrated in FIG. 7, and it can be shown from this figure that a negative supply wire 42 extending from the spring contact can be selectively coupled to a negative bulb wire 44 in electrical communication with the leaf contact 40, whereby actuation of the switch 22 will permit electrical communication between the negative supply wire 42 and the negative bulb wire 44. Further, the switch 22 includes a positive tap wire 46 which extends into the bulb socket 30 to electrically communicate with the second one of the batteries 26, whereby actuation of switch 22 will electrically couple the positive tap wire to a positive indicator wire 48 through a resistor 50, as shown in FIG. 8. The positive indicator wire 48 electrically communicates with the plurality of indicator lights 24 to effect illumination or energization thereof.

Figure 5:
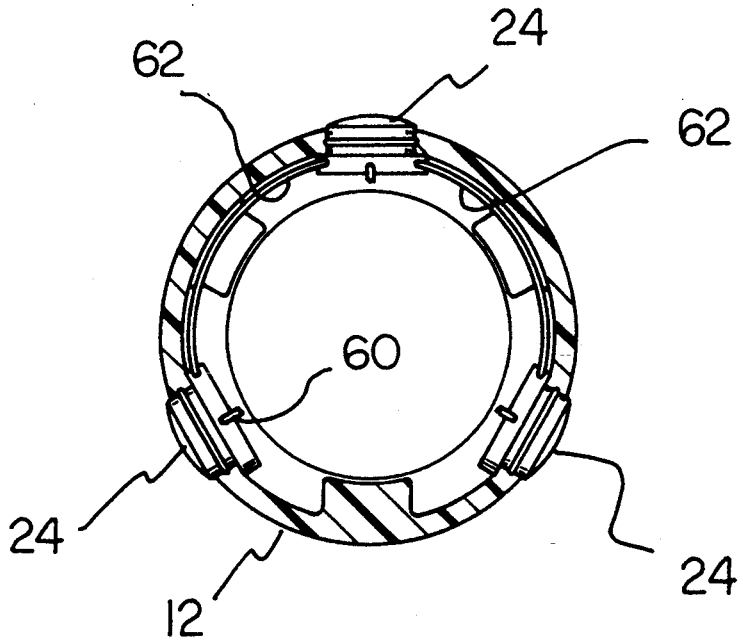
FIG. 5 is a cross sectional view of taken along line 5—5 of FIG. 3.
Figure 6:
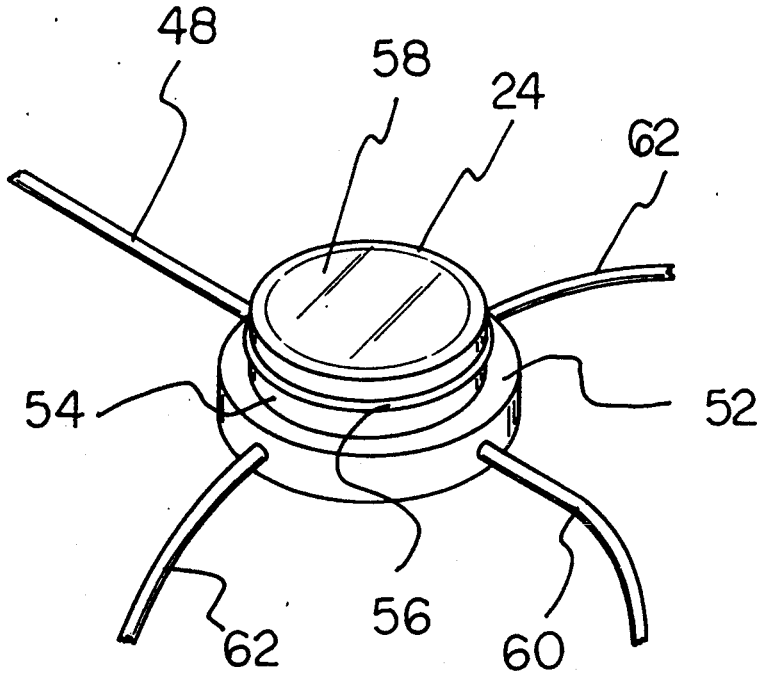
FIG. 6 is an enlarged isometric illustration of an indicator light comprising a portion of the present invention.

Turning now to FIGS. 5 and 6, it can be shown that each of the plurality of indicator lights 24 is mounted through an unlabeled aperture in the main body 12 with the indicator lights 24 being radially spaced about an exterior circumference of the main body. As shown in FIG. 6, each of the indicator lights 24 comprises a substantially cylindrical base 52 with a center cylindrical member 54 projecting from a center of the cylindrical base. A circumferential ridge 56 extends about the center cylindrical member 54 and is cooperable with a circumferential groove formed in the unlabeled apertures within which the indicator light 24 are positioned. By this structure, the indicator lights 24 can be snapped into the apertures, thereby providing for ease of assembly of the device 10. The indicator lights 24 each further comprise an LED positioned within the center cylindrical member 54 and covered by a protective lens 58. The LED is coupled to the positive indicator wire 48, with a negative indicator wire 60 extending into electrical communication with the spring contact 28. Further, a pair of positive bridge wires 62 are in electrical communication with the positive indicator wire 48 and extend to adjacent indicator lights 24 to effect energization thereof, with unused bridge wires being either coupled together, or simply removed by cutting or the like.

Figure 2:
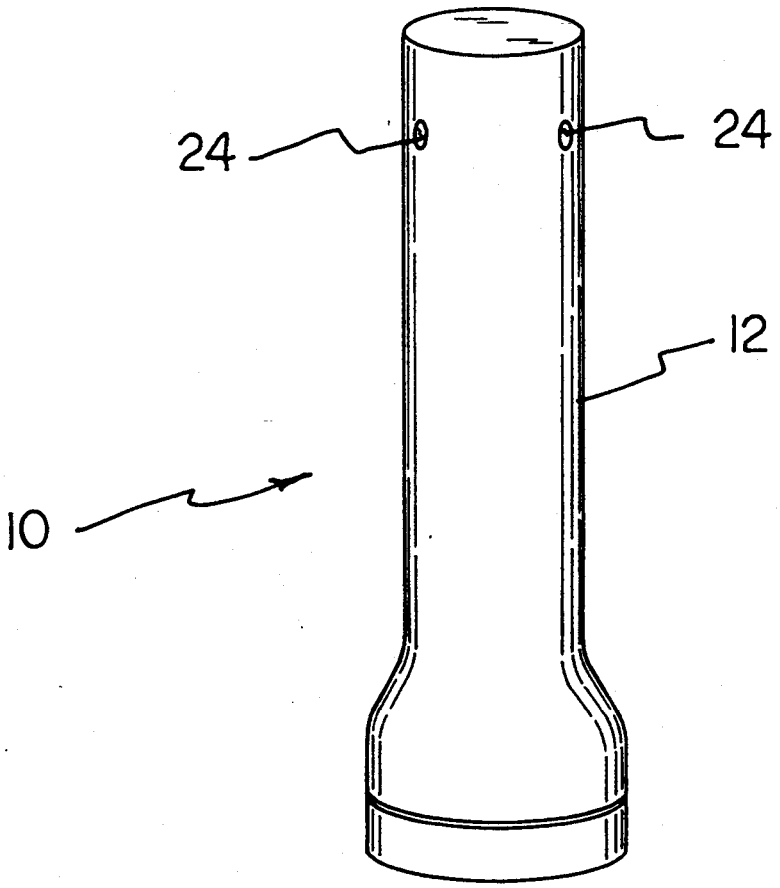
FIG. 2 is a further isometric illustration of the present invention.

In use, the indicating flashlight 10 can be utilized to illuminate an area in front of the second end 18 of the main body 12 in a well understood manner. When the flashlight 10 is positioned upon a ground surface with the light means 20 being sealed against such ground surface, as shown in FIG. 2, the indicator lights 24 will effectively alert an individual to an energization of the light means 20. Because there are at least 3 indicator lights 24 equally and radially spaced about an outer circumference of the main body 12, energization of the light means 20 when the device 10 is positioned as illustrated in FIG. 2 can be ascertained from any angular position about the flashlight. In other words, regardless of the orientation of the flashlight relative to an individual viewing an exterior of the main body 12, at least one of the indicator lights 24 will be visible to alert such individual to an energization of the light means 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A indicating flashlight comprising:

a main body having a first end and an enlarged neck formed at a second end thereof;

a light means coupled to said second end of said main body for illuminating a surrounding area; and, a plurality of indicator lights mounted to an exterior surface of said main body and electrically coupled to said light means such that an energization of said light means will simultaneously energize said indicator lights, thereby indicating such energization of said light means when said light means is not directly visible.

2. The indicating flashlight of claim 1, wherein said main body is substantially hollow and is operable to receive at least one battery of cylindrical configuration therewithin; and further wherein said light means comprises a spring contact mounted within said main body for engaging said battery; a bulb socket mounted within said main body for engaging said battery; a light bulb received within said bulb socket; a parabolic reflector received within said enlarged neck of said main body and positioned about said bulb socket, said parabolic reflector being in electrical communication with said bulb socket; a lens extending across said parabolic reflector; a lens cap threadably engaged to said enlarged neck of said main body; a leaf contact in electrical communication with said parabolic reflector; and a switch in electrical communication with said battery and said leaf contact for electrically coupling said light bulb to said battery to effect energization of said light bulb.

3. The indicating flashlight of claim 2, wherein said switch includes a positive tap wire extending into said bulb socket to electrically communicate with said battery; a positive indicator wire; and a resistor, whereby an actuation of said switch will electrically couple said positive tap wire to said positive indicator wire through said resistor, said positive indicator wire electrically communicating with said plurality of indicator lights to effect energization thereof.

4. The indicating flashlight of claim 3, wherein each of said plurality of indicator lights is mounted through an aperture in said main body with said indicator lights being radially spaced about an exterior circumference of said main body.

5. The indicating flashlight of claim 4, wherein each of said indicator lights comprises a substantially cylindrical base; a center cylindrical member projecting from a center of said cylindrical base; a circumferential ridge extending about said center cylindrical member and cooperable with a circumferential groove formed in said aperture within which said indicator light is positioned, whereby said indicator lights can be snapped into said apertures, thereby providing for ease of assembly of said flashlight.

6. A indicating flashlight comprising:

a main body having a first end and an enlarged neck formed at a second end thereof, said main body being substantially hollow and is operable to receive at least one battery of cylindrical configuration therewithin;

a light means coupled to said second end of said main body for illuminating a surrounding area, said light means comprising a spring contact mounted within said main body for engaging said battery; a bulb socket mounted within said main body for engaging said battery; a light bulb received within said bulb socket; a parabolic reflector received within said enlarged neck of said main body and positioned about said bulb socket, said parabolic reflector being in electrical communication with said bulb socket; a lens extending across said parabolic reflector; a lens cap threadably engaged to said enlarged neck of said main body; a leaf contact in electrical communication with said parabolic reflector; and a switch in electrical communication with said battery and said leaf contact for electrically coupling said light bulb to said battery to effect energization of said light bulb;

a plurality of indicator lights mounted through radially spaced apertures in said main body and electrically coupled to said light means such that an energization of said light means will simultaneously energize said indicator lights, thereby indicating such energization of said light means when said light means is not directly visible, wherein said switch includes a positive tap wire extending into said bulb socket to electrically communicate with said battery; a positive indicator wire; and a resistor, whereby an actuation of said switch will electrically couple said positive tap wire to said positive indicator wire through said resistor, said positive indicator wire electrically communicating with said plurality of indicator lights to effect energization thereof, each of said indicator lights comprising a substantially cylindrical base; a center cylindrical member projecting from a center of said cylindrical base; a circumferential ridge extending about said center cylindrical member and cooperable with a circumferential groove formed in said aperture within which said indicator light is positioned, whereby said indicator lights can be snapped into said apertures, thereby providing for ease of assembly of said flashlight; an LED positioned within said center cylindrical member; a protective lens covering said LED, said LED being coupled to said positive indicator wire and including a negative indicator wire extending into electrical communication with said spring contact; and, a pair of positive bridge wires in electrical communication with said positive indicator wire and extending to adjacent indicator lights to effect energization thereof.

* * * * *